United States Patent [19]

Selivanov et al.

[11] 4,235,260

[45] Nov. 25, 1980

[54] METHOD AND APPARATUS FOR TENSIONING WARP THREADS AT WEAVING A CLOTH ON A LOOM

[76] Inventors: Anatoly G. Selivanov, Donskaya ulitsa, 24, kv. 110; Grigory N. Gromeiko, Sevastopolsky prospekt, 16, kv. 40; Leonty N. Kirillov, ulitsa Vavilova, 58, korpus 2, kv. 115, all of Moscow; Nina S. Zavolokina, ulitsa Sovkhoznaya, 3, Pavlovo-Posad Moskovskoi oblasti; Maria G. Vlaschenko, ulitsa Lobachevskogo, 44, kv. 59, Moscow; Serafima A. Chichëva, poselok Dzerzhinskogo Ljuberetsko raiona, 22, kv. 17, Moskovskoi oblasti; Valery V. Zhivetin, ulitsa Sofii Kovalevskoi, 4, kv. 123, Moscow, all of U.S.S.R.

[21] Appl. No.: 974,220

[22] Filed: Dec. 29, 1978

[51] Int. Cl.[3] ..... D03D 49/22

[52] U.S. Cl. ..... 139/98

[58] Field of Search ..... 139/97, 98, 114, 115

[56] References Cited

U.S. PATENT DOCUMENTS

| | | | |
|---|---|---|---|
| 713,035 | 11/1902 | Wilde | 139/98 |
| 1,023,703 | 4/1912 | Abbott | 139/98 |
| 3,483,897 | 12/1969 | Pfarrwaller | 139/98 |
| 3,759,299 | 9/1973 | Selivanou et al. | 139/97 |

FOREIGN PATENT DOCUMENTS

| | | | |
|---|---|---|---|
| 32271 | 10/1904 | Switzerland | 139/98 |

*Primary Examiner*—Henry Jaudon

*Attorney, Agent, or Firm*—Holman & Stern

[57] ABSTRACT

In accordance with the proposed method, in the course of shedding, thread length compensation after a change of a shed, and adjustment of different amounts of tension applied to tight and slack shed sides, warp threads are placed under a tension close to the looming-up tension maintained while the main shaft turns through from 250° to 340°, and at the beat-up moment the warp threads are subjected to a maximum tension, the thread tension being increased while the main shaft turns through the remaining 20° to 110°. In an apparatus for performing this method is provided a device ensuring different amounts of tension applied to tight and slack shed sides which includes guiding rods installed so as to be able to execute alternating oscillatory up and down motion within the shed and a compensating element placed between the guiding rods so as to be able to periodically act upon the warp threads for the latter to rise and lower between the guiding rods at the beat-up moment of the weft thread. This makes it possible to create a short-time maximum load applied to the warp threads substantially only at the beat-up moment of the weft thread, whereby the breakage rate of the warp threads during weaving is reduced and the production of more hard-textured cloths is ensured.

8 Claims, 13 Drawing Figures

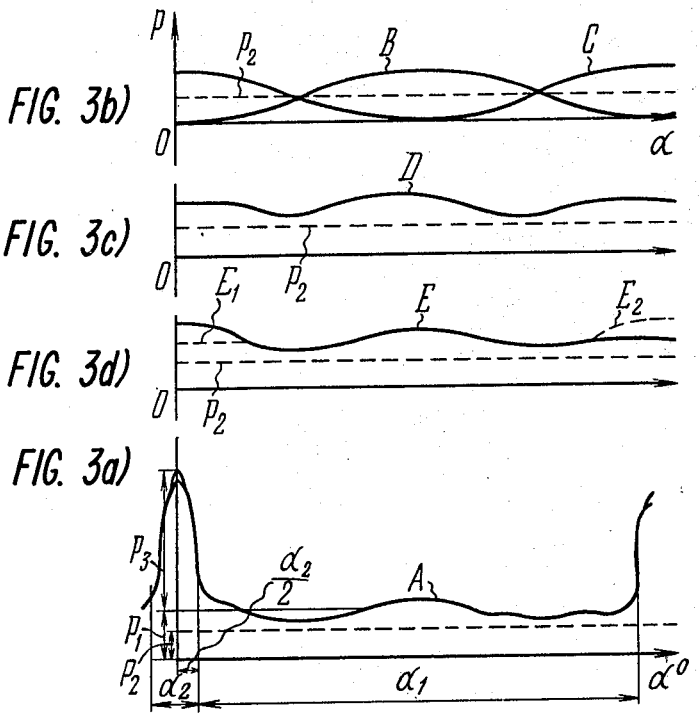
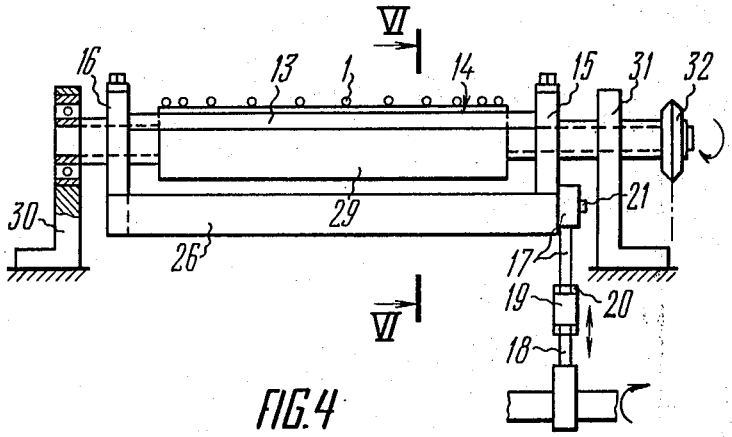
FIG. 4

METHOD AND APPARATUS FOR TENSIONING WARP THREADS AT WEAVING A CLOTH ON A LOOM

FIELD OF THE INVENTION

The present invention relates to weaving and, more particularly, to methods of and apparatus for tensioning warp threads when weaving a cloth on a loom.

The present invention can be effectively realized for the production of all kinds of cloths, linen cloths included, irrespective of the ways and means employed for propulsion of the weft (shuttles, microshuttles, rapiers, etc.).

BACKGROUND OF THE INVENTION

At present, employed in looms currently in use, shuttleless (with microshuttles) and rapier looms included, is a conventional method of cloth formation based on a cyclic principle of performing different operations, namely, shedding, weft propulsion, warp tension (length) compensation at shedding, adjustment of different amounts of tension applied to tight and slack shed sides and beating-up of the weft thread to the fell of the cloth as well as the warp let-off and the cloth take-up. Compensation of the tension applied to the warp threads at shedding is attained at the loom with a rocking back-rest, the difference in amounts of tension applied to the tight and slack shed sides being created by a lease rod. Naturally, the type of the produced cloth governs the weaving particulars: the lifting height of the back-rest above the breast beam, the amount of shift of the back-rest at the compensation of tension during shedding, the relation of amounts of tension applied to shed sides, the amount of crossed shed and beat-up angle.

In looms equipped with a shedding mechanism, weft thread propulsion and beat-up mechanisms, warp let-off motion and cloth take-up means, there is a known apparatus ensuring different amounts of tension applied to the shed sides (cf. German Federal Republic Pat. No. 1,255,599; Cl. 86C. 86C 18/11). The apparatus providing for different amounts of tension applied to the shed sides includes guiding rods installed so as to be able to execute alternating oscillatory up and down motion in the shed and creating definite tension exerted on the warp threads during weaving.

In the process of weaving, the warp threads on these looms undergo a great tension persistently growing till the beat-up moment, and the amount of which considerably exceeds the necessary tension and which is set and maintained during the entire cycle of cloth formation, i.e. while the main shaft of the loom turns through 360°.

The keeping of the warp threads under an increased tension mainly stems from a necessity to create suitable conditions for beating up the weft thread to the fell of the cloth within the loom working cycle, i.e. within a 360° angle of turn of the main shaft and this, to a large measure, adds to yarn fatigue due to multiple loads which, in the final analysis, causes broken ends, defects in cloths and equipment time-outs. Especially, this manifests itself in attempts to produce with the shuttleless looms, outfitted with microshuttles or rapiers, the cloths from bast yarns which are most rigid and least extensible and possess great lengthwise irregularity, or in attempts to produce from any yarns the cloths of increased weft density.

SUMMARY OF THE INVENTION

It is an object of the present invention to provide a method of tensioning warp threads in the course of cloth formation which will decrease the strains existing during the technological process.

Another object of the present invention is to provide an apparatus for tensioning warp threads, used on the loom which will enable to create a short-time tension applied to the warp threads during cloth formation.

One more object of the present invention is to step up the loom productivity.

These and other objects are attained in a method of tensioning warp threads in the production of a cloth on a loom consisting in that formed from the warp threads is a shed wherein a weft thread is inserted, the weft thread is forced to a fell of a cloth, whereupon the warp is let off and the cloth is taken up and during shedding, compensation of the length of the warp threads upon a change of the shed and adjustment of different amounts of tension applied to the shed sides the warp threads are maintained under tension, this tension exerted on the warp threads being increased at a beat-up moment to a maximum, in which method in accordance with the invention, while the shed is being formed, the length of the warp threads at a change of the shed is compensated and different amounts of tension applied to the shed sides, the warp threads are kept under tension close to the looming-up tension, while the main shaft turns through an angle of 250° to 340° , the tension being increased during the remaining 110°–120° angle of turn of the main shaft and being a maximum during beating-up.

Thus, in accordance with the proposed method of tensioning, the warp threads are processed in compliance with the law: "prolonged relaxation" at a looming-up (minimum) tension followed by a short-time maximum loading tension.

This enables to cut down the breakage rate in the process of weaving and to produce more hard-textured cloths due to the weaving process being controlled and, especially, due to the beat-up phase, and thereby to extend the range of cloth structures produced on the loom.

Besides, the proposed method makes it possible to reduce the strains accompanying the weaving process, thereby minimizing the yarn fatigue, as well as to decrease the breakage rate of the warp threads which contributes to the rise of the labour productivity.

It is preferable to apply the maximum tension to the warp threads at the beat-up moment corresponding to a 10°–55° angle of turn of the main shaft after the tension starts increasing.

It is preferable also to establish a 1:2 to 5.0 relationship between the maximum tension of the warp threads and the looming-up tension which enables the production of cloth structures of good quality.

In an apparatus for performing the proposed method and employed on a loom outfitted with a well known shedding mechanism, a mechanism for compensating the length of the warp threads at a change of the shed, a mechanism for propelling the weft thread and beating up thereof, a mechanism for letting off the warp, means for taking up the ready cloth and a device ensuring different amounts of tension applied to the shed sides comprising guiding rods installed so as to be able to execute alternating oscillatory up and down motion, in accordance with the invention, the device for applying different amounts of tension to the shed sides includes a compensating element placed between the guiding rods so as to be able to periodically act upon the warp threads for the latter to rise between the guiding rods and to provide for maximum tension at the moment of the beat-up or the weft thread, the compensating element passing through rotatable brackets whereon the guiding rods are mounted.

Due to the availability of the compensating element disposed between the guiding rods it is possible to develop a compact structure of the apparatus complying with the overall dimensions of the looms currently used and allowing the attending personnel to service the looms with no difficulties experienced. This looks promising for simplifying the warp feeding mechanism.

The preset looming-up tension of the warp threads is maintained during the greater part of the loom operating cycle and is chosen so as to provide for only the qualitative shedding: without letting the warp threads adhere to one another. Compensation of tension (length) of the thread at shedding is realized by a rocking back-rest and is equal to the tension in a shedding antiphase. Different tensioning of the shed sides is created in compliance with the preset law by well known cam (without dwell) or tappet (with dwell) mechanisms.

According to the invention, the compensating element represents a rotatable shaft of rhombard cross-section with the ends thereof mounted in stationary supports due to which it is possible to produce cloths with a cover factor up to 0.8.

According to an alternative embodiment of the invention, the compensating element is made as a strip provided with a profiled cover-plate and installed so as to be free to execute reciprocating motion in the vertical plane under the action of the tappet mechanism, the ends of the strip being lodged in slots of a stationary support.

Due to such a design of the compensating element it is possible to weave cloth structures with a cover factor higher than 0.8.

According to another embodiment of the invention, the rotatable brackets are rigidly coupled to one another and are provided with a device for adjusting the angle of turn of the brackets.

It can be seen that the herein disclosed method of and apparatus for tensioning the warp threads make it possible to reduce strains accompanying the weaving process and to cut down the breakage rate of the warp threads thereby increasing the productivity of the weaver and the loom. In addition, it is possible to extend the range of produced cloth structures due to the production of more hard-textured cloths.

BRIEF DESCRIPTION OF THE DRAWINGS

Given below is a detailed description of the present invention with reference to the accompanying drawing, wherein:

FIG.3*a*, FIG. 3*b*, FIG. 3*c* and FIG. 3*d* are diagrammatic representations of tension applied to the warp threads in the course of cloth weaving during one revolution of the main shaft;

FIG. 4 is a general view of a device providing for different amounts of tension complete with a compensating element in the form of a shaft;

DETAILED DESCRIPTION OF THE INVENTION

Figures 1A, 1B, 2A, 2B:
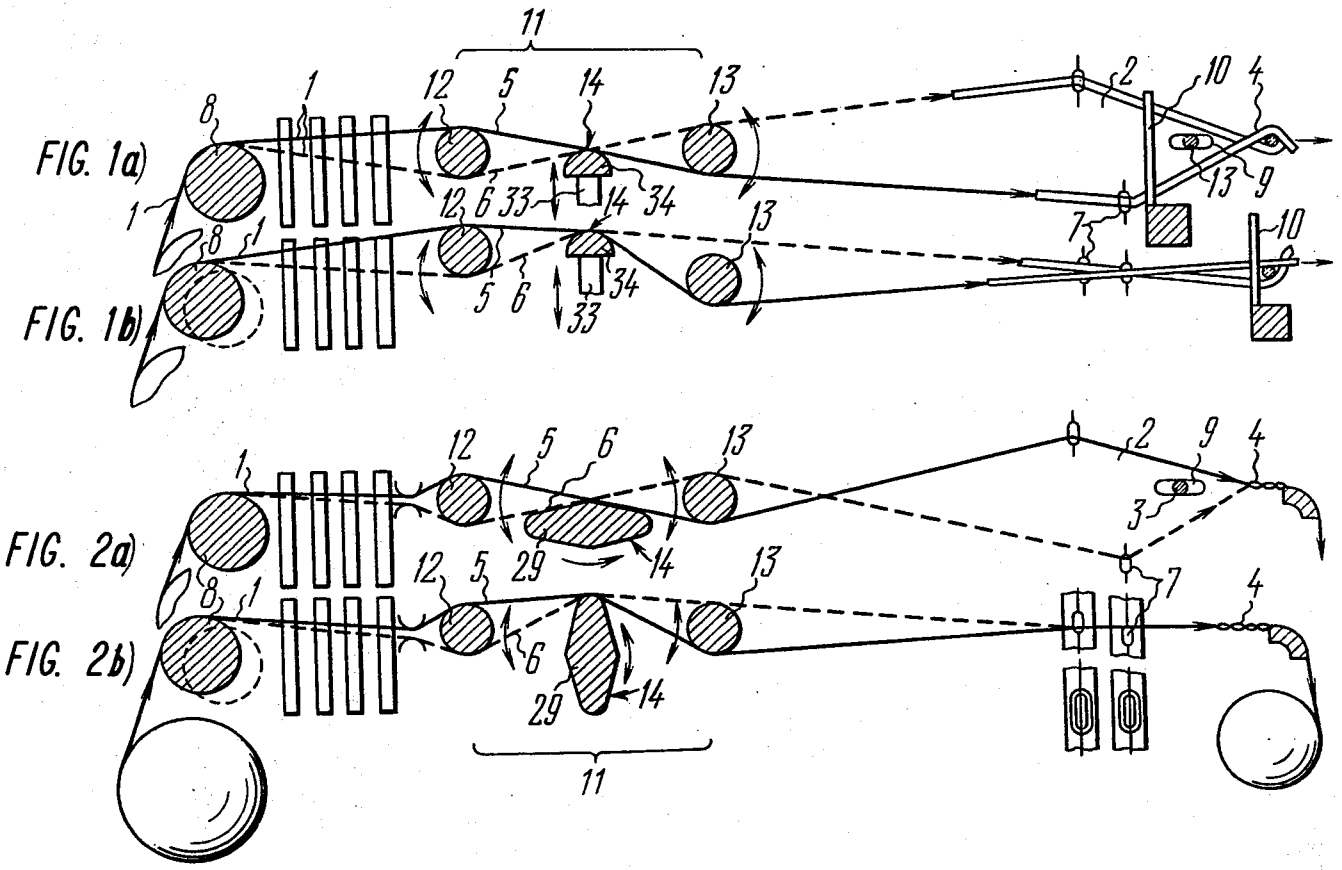
FIG. 1*a* and FIG. 1*b* show schematically a process of cloth formation.
FIG. 2*a* and 2*b* show schematically the process of FIGS. 1*a* and 1*b* with an alternative embodiment of a compensating element.

In accordance with a known method of the production of a cloth from warp threads 1 (FIGS. 1*a, b* and 2*a,b*) a shed 2 is formed and a weft thread 3 is inserted into the formed shed 2, the weft thread 3 is thereafter beaten up to a fell 4 of a cloth, whereupon the warp threads 1 are let off from the beam and the cloth is taken up by an amount equal to the formed element of the cloth, the warp threads 1 being kept under tension during the cloth weaving process. At the same time, prior to propelling the weft thread 3 through the shed 2, the length of the warp threads 1 is compensated for when the shed is reversed is changed and different amounts of tension are applied to sides 5 and 6 of the shed.

While the shed is formed, the length of the warp threads at a change of the shed is compensated, the sides 5 and 6 of the shed are tensioned differently, a tension $P_1$ (FIG. 3*a*) of the warp threads is established to be close to a looming-up tension $P_2$ of the warp threads and this tension $P_1$ is maintained while the main shaft turns through an angle $\alpha_1$, equal to 250–340°.

At the moment when the weft thread 3 is forced to the fell of the cloth the warp threads are placed under a maximum tension $P_3$ and increased tension being maintained while the main shaft turns through an angle $\alpha_2$ equal to the remaining 110–20°of the shaft rotation. The maximum tension $P_3$ of the warp threads is applied substantially at the moment of beat-up of the weft thread at a 55–10° angle of turn of the main shaft equal to $2/\alpha_2$ after the tension has started to increase.

A line A on FIG. 3*a* curve of the tension applied to the warp threads which acts upon these threads during one revolution of the main shaft through 360°. This curve A of the tension at the angle $\alpha_1$ of turn of the main shaft is plotted on the basis of tensions applied to the warp threads at shedding and shown by a line B (FIG. 3*b*) and in the course of compensation of the length of the warp threads at a change of the shed as is shown by a line C.

The tension resulting from summation of the tension of the warp threads at shedding and that applied in the course of compensation of the length of the warp threads is shown by a line D (FIG. 3*c*).

FIG. 3*d* illustrates the influence of the difference in amounts of the tension applied to the shed sides on the increase of the tension shown by a line E, the broken line (FIG. 3*a, b,c,d*) showing the looming-up tension $P_2$ of the warp threads, while a broken line $E_1$ on FIG. 3*d* shows a lessening of the tension on the tight shed side and a line $E_2$ shows the tension applied to the shed tight side.

The ratio between the maximum tension $P_3$ of the warp thread and the looming-up tension $P_2$ is taken to be 1:2 to 5.

For the proposed method to be realized, it is necessary to establish in a known manner the looming-up tension $P_2$ of the warp threads, the crossed shed type and value, the moment of the beat-up of the weft thread to the fell of the cloth and the tensioning of the warp threads as it was described above.

To produce a cloth with a cover factor up to 0.8 the maximum tension $P_3$ on the warp threads is exerted while the main shaft is turning by an angle from 60° to 110° and when weaving a cloth with a cover factor higher than 0.8, the maximum tension is applied to the warp threads at a 20°-60° angle of turn of the main shaft.

The herein disclosed method of tensioning the warp threads may be effected in any loom known in the art comprising a shedding mechanism 7 (FIGS. 1 and 2), a mechanism 8 for compensating the length of the warp threads at a change of the shed, a mechanism 9 for inserting the weft thread into the shed, a mechanism 10 for beating up the weft thread to the fell of the cloth, a warp let-off mechanism, a means for taking up the formed cloth (not shown) and a device 11 providing for different amounts of tension applied to the shed sides. All these mechanisms are shown in FIGS. 1 and 2 but schematically since the design thereof is widely known in the art and for realizing the proposed method it is not required that their structure be somehow modified. It is selfevident that all these mechanisms are functionally coupled and operate in synchronizm, whereby the normal process of cloth formation is ensured.

The device 11 providing for different amounts of tension applied to the shed sides includes guiding rods 12 and 13 installed so as to be able to execute alternating oscillatory motion in the vertical plane, and a compensating element 14 placed between the guiding rods 12 and 13 so as to be able to periodically act upon the warp threads at the moment the weft thread is beaten up. The compensating element 14, as it is, serves to raise the warp threads 1 between the guiding rods 12 and 13 and to create the maximum tension $P_3$ applied to these threads.

The guiding rods 12 and 13 are mounted on rotatable brackets 15 and 16 (FIGS. 4 and 5) through which the compensating element 14 passes. The brackets 15 and 16 are provided with a device for adjusting the angle of turn thereof.

The brackets 15 and 16 (FIG. 4) with the guiding rods 12 and 13 are turned through the medium of rods 17 and 18 joined together by a threaded sleeve 19 and locked by nuts 20. The rod 17 is coupled with the bracket 15 by a stud 21 passing through a slot 22 (FIG. 6) in the bracket 15 and secured therein by any known means allowing the stud 21 to be displaced in the slot 22 for adjusting the angle of turn of the brackets 15 and 16.

Figure 5:
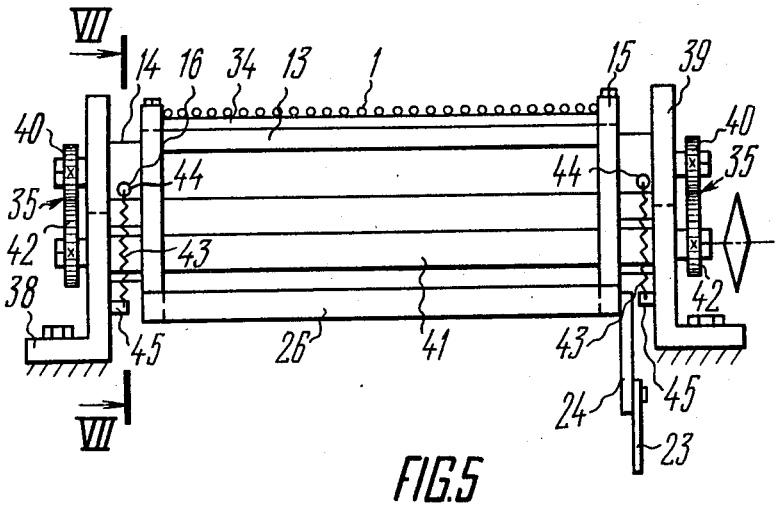
FIG. 5 same as in FIG. 4 with the compensating element in the form of a strip.

From FIG. 5 it may be noted that the brackets 15 and 16 are caused to turn by any drive though a rod 23 hinge-coupled with an abutment 24 of the bracket 15. The abutment 24 is provided with a slot 25 (FIG. 7) wherein the hinge of the rod 23 may be shifted for adjusting the angle of turn of the brackets 15 and 16 complete with the guiding rods 12 and 13.

The brackets 15 and 16 are interconnected by strips 26 (FIGS. 4 and 5).

The ends of the guiding rods 12 and 13 are lodged in slots 27 (FIGS. 6 and 7) of the brackets 15 and 16 and are held in the position by screws 28 which serve as a means for adjusting the position of the guiding rods 12 and 13 in height, as a result of which the length of the warp threads is compensated for and the tensioning thereof at shedding is achieved at different heights of the shed.

Figure 6:
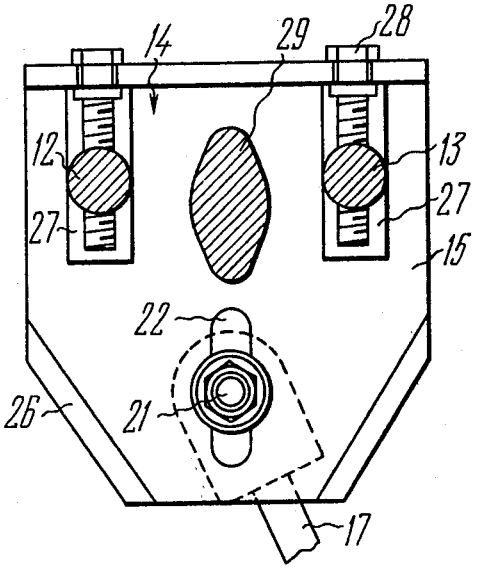
FIG. 6 is a section along line VI—VI of FIG. 4.
Figure 8:
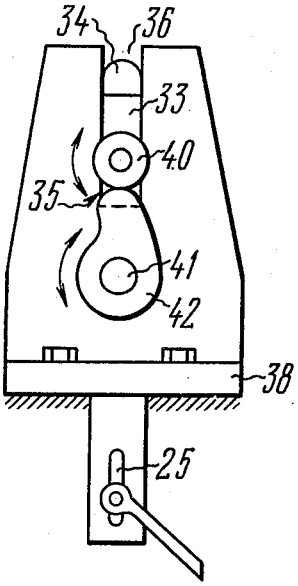
FIG. 8 is a side view of FIG. 5.

Variation of the amplitude of oscillation of the guiding rods 12 and 13 for the apparatus shown in FIGS. 5 to 8 is attained through the change of position of the hinge of the rod 23 in the slot 25 of the bracket, and for the apparatus illustrated in FIGS. 4, 6, through the setting of the rods 17 and 18 closer together or further apart by means of the threaded sleeve 19. During loom tuning the compensating element 14 is adjusted to be in antiphase with the shedding mechanism.

The compensating element 14, according to FIGS. 2, 4, 6, is in the form of a rotatable shaft 29 of rhombord cross-section whose ends are mounted in stationary supports 30 and 31 (FIG. 4). The shaft 29 is driven by a sprocket 32 activated by any known drive.

The guiding rods 12 and 13 (FIG. 2) extend lengthwise the generatrix of the shaft 29 at an equal distance therefrom, as a result of which the shaft 29 provides a centre around which the guiding rods 12 and 13 oscillate.

In the process of weaving, the warp threads, as is shown in FIG. 2*a* after having passed through a bank of drop-wires are divided by the guiding rod 12 into two shed sides, tight 5 and slack 6, which run over the shaft 29 and envelope the rod 12 as shown in FIG. 2*a* to be sequentially drafted through healds of the shedding mechanism 7. In this case, the shed is open to the upmost. With the shaft 29 turning to assume a position shown in FIG. 2*b*, the shaft 29 lifts the warp threads upward and places the warp threads under the maximum tension, while the heald of the shedding mechanism depresses to the shed line, with the mechanism 8 compensating for the length of the warp threads (the back-rest) receding as is shown in FIG. 2*b*. At this time, the guiding rods 12 and 13 execute oscillatory motion, thereby controlling the shed sides in compliance with the loom peration cyclogram. It should be noted that the shaft 29 may rotate both in the direction of the warp advance and in the opposite direction.

With the shaft 29 in a position shown in FIG. 2*a*, the shaft 29 does not act upon the warp threads and they are subjected to the tension $P_1$ close to the looming-up tension $P_2$.

Figure 7:
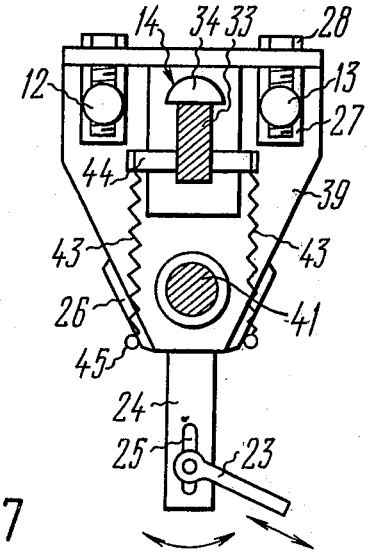
FIG. 7 is a section along line VII—VII of FIG. 5.

According to FIGS. 1,5, 7, 8, the compensating element 14 is made as a strip 33 with a profiled cover-plate 34 the shape of which is shown in FIGS. 1 and 7. The strip 33 is installed so as to be able to reciprocate in the vertical plane under action of a tappet mechanism 35 (FIG. 8), the ends of the strip 33 being disposed in slots 36 of stationary supports 38 and 39 (FIG. 5) and provided with rollers 40. The tappet mechanism 35 (FIG. 8) includes a shaft 41 rotated by any known drive, the ends of which carry tappets 42 secured thereon and cooperating with the rollers 40. The strip 33 is elastically urged against the tappets 42 by springs 43 (FIGS. 5, 7), each of which is secured by one end to a stud 44 of the strip 33 and by the other end, to a stud 45 of the stationary supports 38 and 39.

In the process of weaving, the operation of the device providing for different amounts of tension applied to the shed sides proceeds in a manner similar to that described with reference to FIG. 2*a*, *b*, the only difference being in that the compensating element 14 (FIG. 1*b*), that is the strip 33 with the cover-plate 34, reciprocates, in the vertical plane and, while in the uppermost position, acts with its cover-plate 34 upon the warp threads and lifts them, thereby creating the maximum tension $P_3$ maintained during the process of beating-up of the weft thread to the fell of the cloth. The weft thread having been beaten up, the strip 33 lowers, the warp threads are relieved of the maximum tension and are subjected only to the tension $P_1$ close to the looming-up tension $P_2$.

Thereafter, the operating cycle of the loom is repeated.

What is claimed is:

1. A method of tensioning warp threads in the production of a cloth on a loom including the steps of forming a shed from the warp threads, inserting a weft thread into the shed, beating up the weft thread to a fell of the cloth, letting off the warp, taking up the cloth and changing the shed, characterized in that in the course of shedding different amounts of tension are applied to the warp threads of the respective shed sides and when the shed is changed, the length of the warp threads of each shed side is compensated for, and wherein during the process of shedding, of compensation of the length of the warp threads at a change of the shed, and of adjustment of the tension applied to the shed sides, the warp threads are subjected to a tension of an amount close to the looming-up tension of the warp threads and are maintained at this tension while the main shaft of the loom turns through an angle of from 250° to 340°; the tension on the warp threads being increased during the remaining 20°–110° of the rotation of the main shaft and being at a maximum during beating up of the weft thread.

2. A method as claimed in claim 1, wherein the maximum tension is applied to the warp threads at a 10°–55° angle of turn of the main shaft from the moment the tension starts increasing.

3. A method as claimed in claim 1, wherein the ratio between the maximum tension of the warp threads and the looming-up tension is chosen to be 1:2 to 5.0.

4. In a loom comprising a shedding mechanism, a shed-changing mechanism, mechanisms for inserting a weft thread and beating up the weft thread to a fell of cloth, a warp let-off mchanism, and a means for taking up formed cloth the improvement including: a mechanism for compensating for the length of the warp thread upon a change of the shed, and a device for providing different tensioning of the threads of the respective shed sides; said device including guiding rods for providing different tensioning of the shed sides, the guide rods being installed to execute alternating oscillatory up and down motion within the shed; a compensating element installed between said guiding rods for periodically acting upon the warp threads for the latter to rise between the guiding rods and to create maximum tension in the warp threads at the moment of beating up of the weft thread; a means for displacing said compensating element for the latter to periodically act upon the warp threads; rotatable brackets mounting said guiding rods and through which said compensating element passes, said brackets being adapted for imparting alternating oscillatory motion to the guiding rods; and a drive means for turning said brackets.

5. An apparatus as claimed in claim 4, including stationary supports for said compensating element and said compensating element comprising a rotatable shaft of a rhomboid cross-section with ends thereof placed in said stationary supports.

6. An apparatus as claimed in claim 4, including stationary supports for said compensating element, said compensating element comprising a strip with a profiled cover-plate installed in said supports to execute reciprocating motion in the vertical plane; and a tappet mechanism for imparting said reciprocating motion to the strip.

7. An apparatus as claimed in claim 6, wherein the strip is elastically urged against a tappet of said tappet mechanism.

8. An apparatus as claimed in claim 4, wherein said rotatable brackets are rigidly interconnected and provided with a device for adjusting an angle of turn of the brackets.

* * * * *